US007506788B2

(12) United States Patent
Liang et al.

(10) Patent No.: US 7,506,788 B2
(45) Date of Patent: Mar. 24, 2009

(54) TRANSMISSION MECHANISM FOR ELECTRICAL NAIL GUN

(75) Inventors: Chia-Sheng Liang, Taipei Hsien (TW); Chin-Lung Chang, Taipei Hsien (TW); Chu-Hsiang Tseng, Taipei Hsien (TW)

(73) Assignee: De Poan Pneumatic Corp., Taipei (TW)

( * ) Notice: Subject to any disclaimer, the term of this patent is extended or adjusted under 35 U.S.C. 154(b) by 68 days.

(21) Appl. No.: 11/863,768

(22) Filed: Sep. 28, 2007

(65) Prior Publication Data

US 2009/0032566 A1 Feb. 5, 2009

(30) Foreign Application Priority Data

Aug. 3, 2007 (TW) ..... 96128577 A

(51) Int. Cl.
*B25C 5/15* (2006.01)

(52) U.S. Cl. ..... 227/133; 227/132; 227/129; 227/131

(58) Field of Classification Search ..... 227/132, 227/133, 129, 131
See application file for complete search history.

(56) References Cited

U.S. PATENT DOCUMENTS 3,581,855 A * 6/1971 Taeffner et al. ..... 192/18 B
6,109,122 A * 8/2000 Bori et al. ..... 74/7 E
6,607,111 B2 8/2003 Garvis et al.
6,630,760 B2 * 10/2003 Fulton et al. ..... 310/75 R
6,669,072 B2 12/2003 Burke et al.
6,755,336 B2 * 6/2004 Harper et al. ..... 227/129
6,796,475 B2 * 9/2004 Adams ..... 227/2
7,007,618 B1 * 3/2006 Chiu ..... 112/275
7,334,715 B2 * 2/2008 Oda et al. ..... 227/2
7,469,811 B2 * 12/2008 Shima et al. ..... 227/131
2002/0104869 A1 * 8/2002 Garvis et al. ..... 227/138
2003/0102737 A1 * 6/2003 Fulton et al. ..... 310/75 R
2005/0218177 A1 10/2005 Berry et al.
2005/0242154 A1 * 11/2005 Leimbach ..... 227/131
2007/0095876 A1 * 5/2007 Oda et al. ..... 227/131
2007/0210134 A1 * 9/2007 Oda et al. ..... 227/131
2008/0061105 A1 * 3/2008 Zachrisson et al. ..... 227/131
2008/0067213 A1 * 3/2008 Shima et al. ..... 227/129
2008/0073405 A1 * 3/2008 Shima et al. ..... 227/131

FOREIGN PATENT DOCUMENTS

EP 1582300 A2 10/2005
WO 2005097428 A2 10/2005

* cited by examiner

*Primary Examiner*—Brian D Nash

(57) ABSTRACT

A transmission mechanism for an electrical nail gun includes a rotary transmission unit and a linear transmission unit in a housing of the electrical nail gun. The rotary transmission unit includes a motor driven by electricity, a flywheel driven by the motor and extending to form a cylinder thereon, a solenoid activated by electricity, and a moveable driving wheel adjacent to an end side of the cylinder. A clutch is formed between the cylinder and the driving wheel. The solenoid is buried in the cylinder so that a magnetic conductivity loop is constructed around the solenoid to produce the magnetic field when the solenoid is activated. The driving wheel is attracted to move to an engagement position to be driven by the flywheel, thereby driving the linear transmission unit to impact a nail when the solenoid is activated by electricity, and the driving wheel returns to a disengagement position to disengage from the flywheel, thereby stopping driving the linear transmission unit when the solenoid is demagnetized.

10 Claims, 10 Drawing Sheets

TRANSMISSION MECHANISM FOR ELECTRICAL NAIL GUN

BACKGROUND OF THE INVENTION

1. Field of the Invention

The present invention relates to a transmission mechanism for an electrical nail gun, and more particularly to a transmission mechanism in which a solenoid is received in a cylinder of a flywheel, a clutch is located between the cylinder and an end side of a driving wheel, a magnetic field is produced by activating the solenoid to control engagement or disengagement of the driving wheel to transmit kinetic energy of the rotary flywheel.

2. Description of Related Art

An electrical nail gun is a type of tool used to drive nails into wood or some other kind of material. Usually, there is a battery pack or an AC electrical power source in a housing of the electrical nail gun to provide electrical power to a motor, thereby rotating the motor. A rotary kinetic energy of the motor is transformed into a linear kinetic energy by a transmission mechanism to drive a strike bar to impact nails.

Among a more advanced technology, many US patents, such as U.S. Pat. No. 6,607,111 and U.S. Pat. No. 6,669,072 and so on, teach a flywheel driven by a DC motor, a clutch assembly being capable of linear movement by traction of a wire disposed on an axis of a solenoid. The clutch assembly has a wire drum and connects to a driving stand via at least a wire. When a nail gun is driven by a user, the clutch assembly is moved along an axis direction to mesh with a flywheel which is rotating, thereby rotating the clutch assembly. Therefore, a rotary kinetic energy is transformed into a linear kinetic energy of the strike bar to then impact nails via traction of the wire. However, the structure of the clutch assembly is complicated due to too many components. The solenoid is disposed in the housing away from the flywheel, therefore, it is a disadvantage to save configuration room.

In addition, a number of patents, such as U.S.P 20050218177, WO No. 2005097428, and EP No. 1582300 and so on, teach a driver produced by a solenoid. The driver linearly pushes a swing arm forming a roller to swing. A driving stand of a stroke bar is pushed by the roller to urge the driving stand to mesh with a rotating flywheel. Thus, a rotary kinetic energy of the flywheel is transformed into a linear kinetic energy of a stroke bar to impact a nail. Wherein, the roller, the driving stand, and the flywheel cooperatively form a clutch assembly being capable of engagement or disengagement. However, during a long-term use, an abrasion may be produced by friction between the roller, the driving stand, and the flywheel to thereby broaden mesh clearance. When the driving stand of the stroke bar is pushed by the roller towards the flywheel to mesh with the flywheel, a component acting force is produced not along a direction of impacting the nail due to clearance, thereby affecting safety and stability as the driving stand is driving the stroke bar to impact the nail. Furthermore, the solenoid is disposed in the housing away from the flywheel or the clutch assembly; therefore, it is a disadvantage to save configuration room. Accordingly, the above-mentioned problems need to be further improved.

SUMMARY OF THE INVENTION

What is needed, therefore, is to provide a transmission mechanism configured for an electrical nail gun, which simplify a clutch assembly in a previous technology, save space for a solenoid, and overcome not to generate a component force not along stroke nail direction during long-term use of the nail gun.

An object and effect of the present invention is carried out through the following technology means. The transmission mechanism for an electrical nail gun of the present invention includes a rotary transmission unit and a linear transmission unit in a housing of the electrical nail gun. The rotary transmission unit includes:

a motor driven by electricity;

a flywheel driven by the motor, the flywheel pivotally mounted on a stop shaft, a cylinder extended from a side of the flywheel thereon and made of magnetic material, and the cylinder defining a ring-shaped receiving chamber therein;

a solenoid activated by electricity and buried in the receiving chamber, wherein a magnetic conductivity loop is constructed around the solenoid to produce the magnetic field when the solenoid is activated; and a moveable driving wheel rotatably disposed between an engagement position and a disengagement position adjacent to an end side of the cylinder, wherein two opposite slantwise end surfaces are respectively formed on the cylinder and the driving wheel to be used as a clutch;

wherein the driving wheel is attracted to move to the engagement position to be driven by the flywheel, thereby driving the linear transmission unit to impact a nail when the solenoid is activated by electricity, and the driving wheel returns to the disengagement position to disengage from the flywheel, thereby stopping driving the linear transmission unit when the solenoid is demagnetized.

In addition, the present invention includes a ring-shaped bearing. The ring-shaped bearing is made of a magnetic material, and securely mounted on the stop shaft. The solenoid is wrapped around an insulated ring stand, and securely disposed on the stop shaft via the bearing. Alternatively, the ring stand is directly mounted on the stop shaft without the bearing.

The present invention further includes a ring-shaped traction stand made of a magnetic material. The ring-shaped traction stand is moveably and pivotally mounted on the stop shaft, and the driving wheel is disposed on the traction stand. Wherein an end of the traction stand is formed to have at least a protruding block which is used to push the driving wheel to move towards the cylinder. Besides, the traction stand may be replaced by a ring-shaped disk stand made of magnetic material. The disk stand is securely mounted on the stop shaft, and a plurality of rolling posts is accommodated around the disk stand. The driving wheel is moveably and pivotally disposed on the rolling posts.

The present invention further includes an elastic member. The elastic member is configured for exerting an acting force on the driving wheel, thereby pushing the driving wheel from the engagement position to the disengagement position, and the acting force should be less than an applied force which the magnetic field attracts the driving wheel to move. The elastic member is disposed between the ring-shaped bearing securely mounted on the stop shaft and the traction stand moveably and pivotally attached to the stop shaft. Besides, the elastic member is disposed between the ring-shaped disk stand and the driving wheel when the traction stand is replaced by the disk stand.

Furthermore, the driving wheel is substantially a gear wheel, and the linear transmission unit includes a rack in mesh with the gear wheel to helpfully transform the rotary kinetic energy of the driving wheel into the linear kinetic energy of the linear transmission unit.

It is a novelty for employing magnetic field effect of the solenoid to control engagement or disengagement of the driving wheel in/from the flywheel and for a transmission method of kinetic energy. Because the solenoid is received in the cylinder adjacent to the flywheel, and the two opposite end surfaces of the cylinder and the driving wheel constitute the clutch, the configuration space of the components is sufficiently saved. Moreover, the rotary kinetic energy of the flywheel is fully transmitted to the driving wheel due to the two opposite end surfaces of the driving wheel and the cylinder. In greater detail, the gear wheel is used as the driving wheel and the rack is used as the follower component of the linear transmission unit. Thus, it may be a advantageous to transform the rotary kinetic energy of the gear wheel into the linear kinetic energy of the rack, thereby improving durability of the transmission mechanism for the electrical nail gun even if the gear wheel and the rack is worn in long-termed use.

Other advantages and novel features will be drawn from the following detailed description of preferred embodiment with the attached drawings, in which:

DETAILED DESCRIPTION OF THE INVENTION

Figure 1:
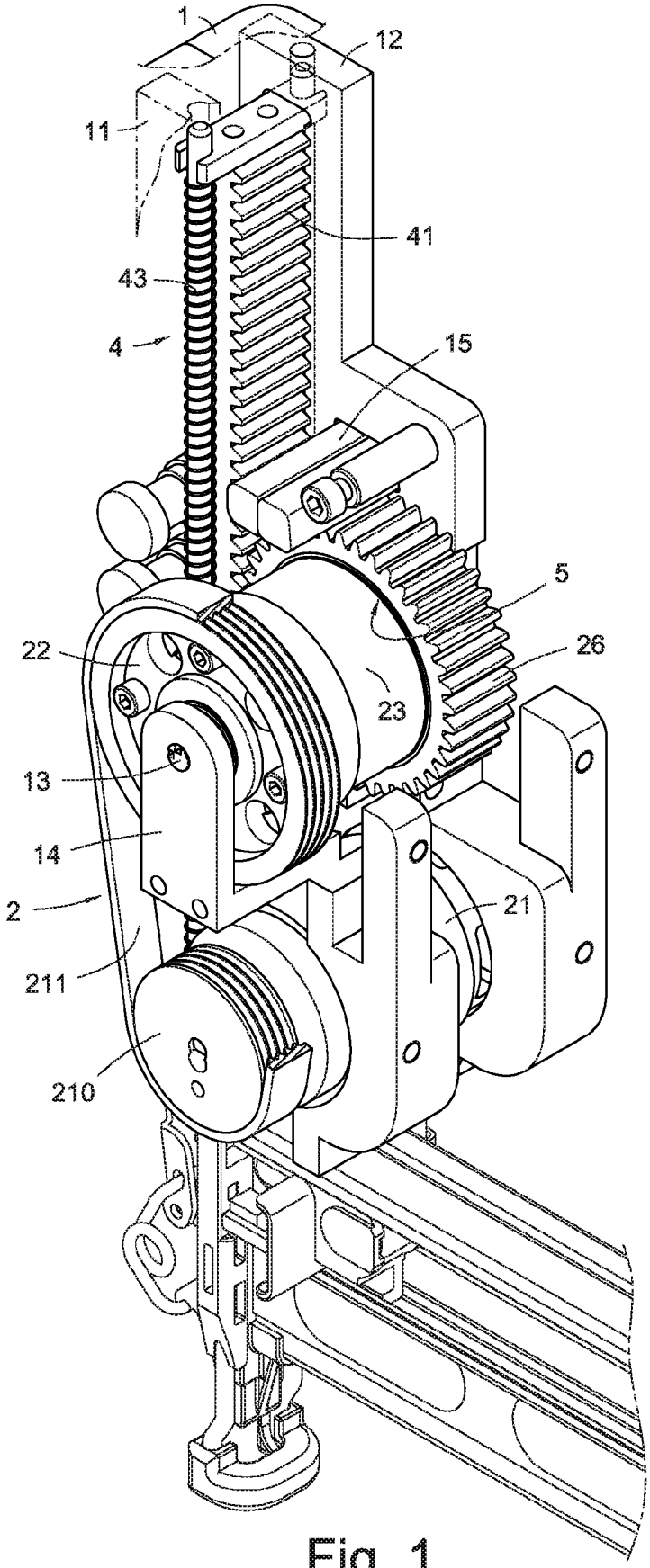
FIG. 1 is an perspective view of a transmission mechanism for an electrical nail gun in accordance with a preferred embodiment of the present invention.
Figure 2:
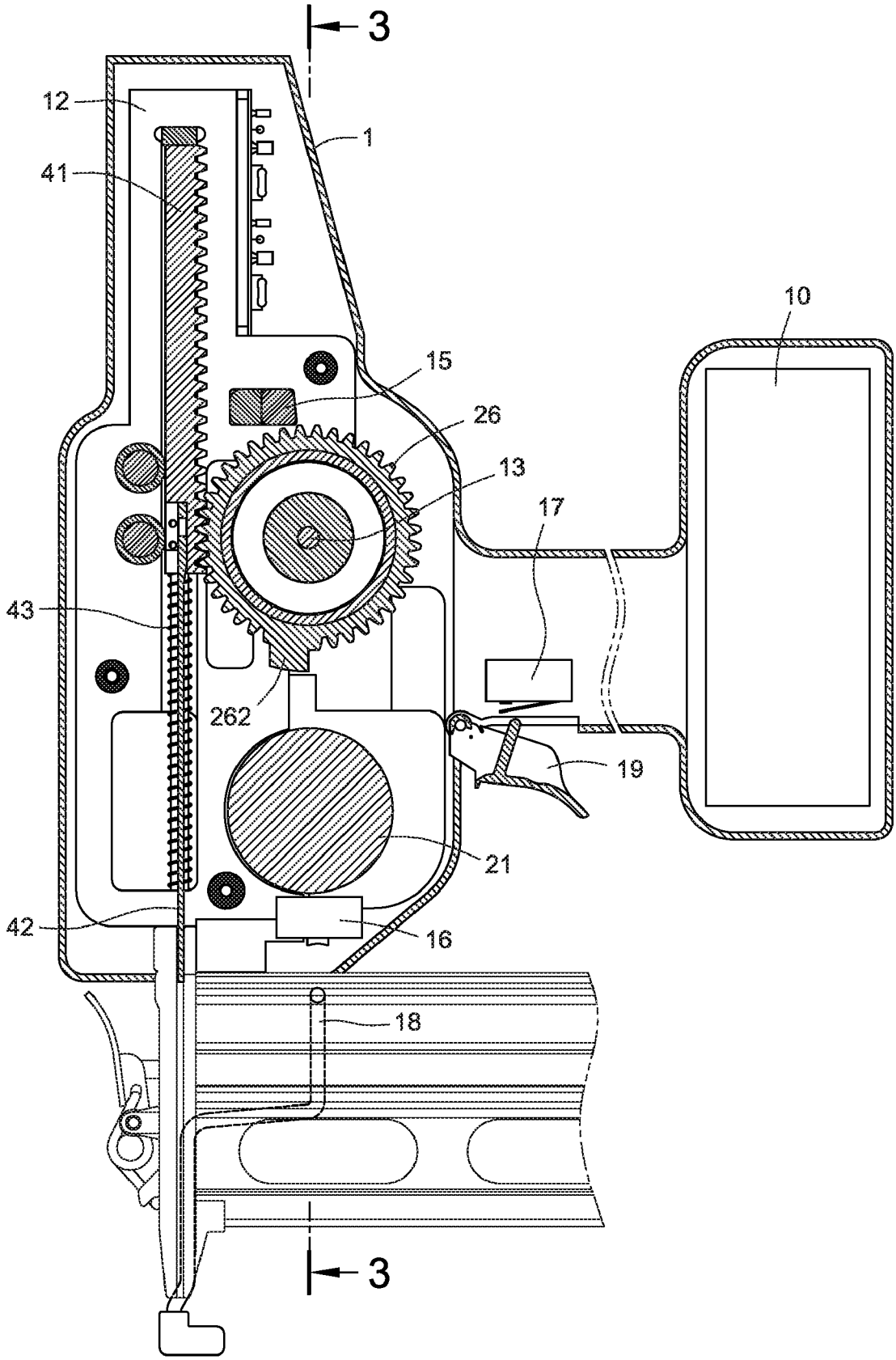
FIG. 2 is a cutaway view of a transmission mechanism for an electrical nail gun in accordance with the first preferred embodiment of the present invention.
Figure 3:
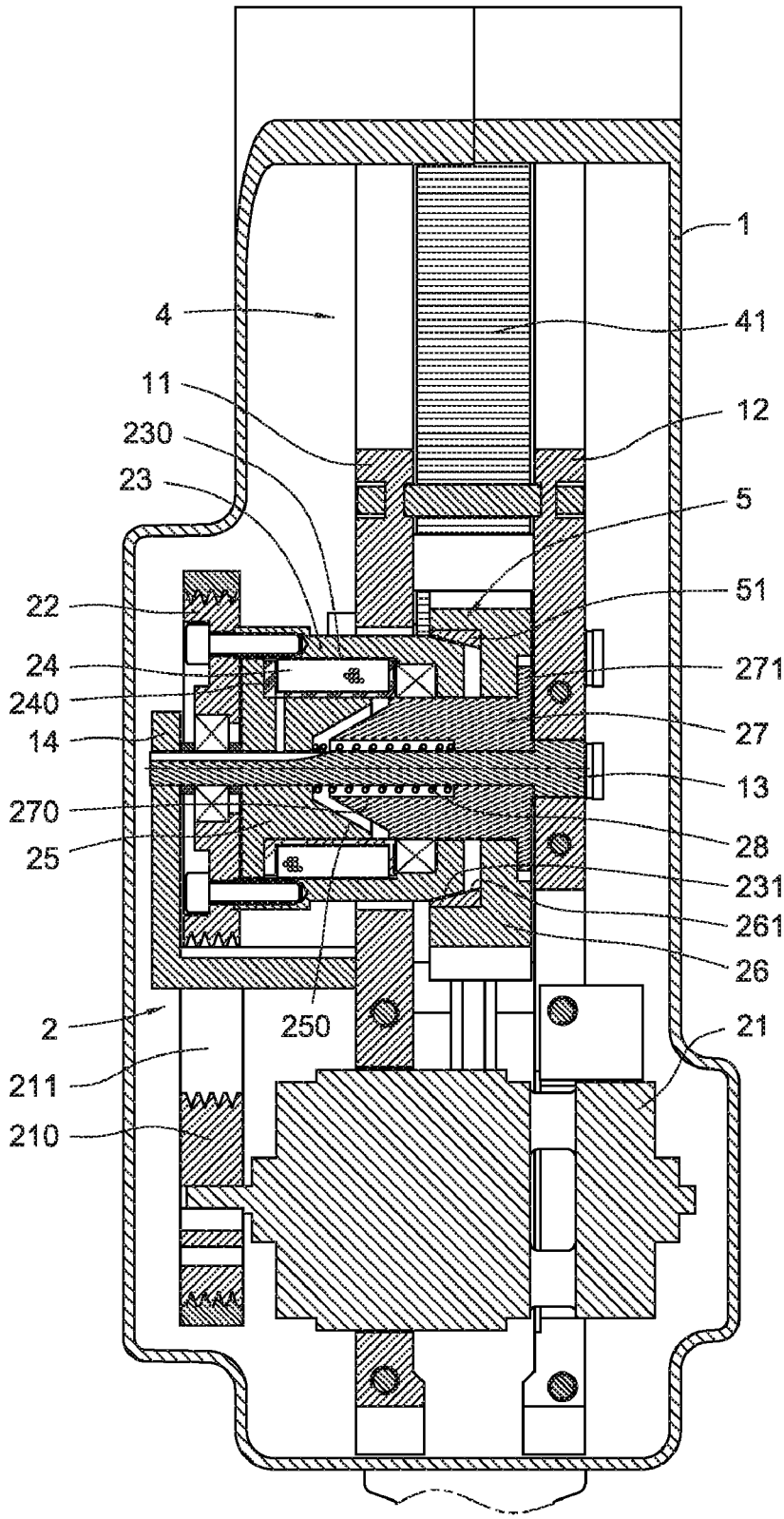
FIG. 3 is a cross sectional view of FIG. 2, taken along the line 3-3.

Referring to FIGS. 1 to 3, a transmission mechanism for an electrical nail gun in accordance with a first embodiment of the present invention is shown. A suitable power source, such as a battery pack 10 for providing direct current to the transmission mechanism, is received in a distal end of a housing 1. Two opposing supporting bracket 11, 12 are formed on a head portion of the housing 1 to mount a rotary transmission unit 2 and a linear transmission unit 4 thereon. A first switch 16 and a second switch 17 are formed on the housing 1. The first switch 16 is disposed on a bottom end of the housing 1 for a safe sliding rod 18 being capable of touching the first switch 16. The second switch 17 is located on an end side of the housing 1 where a trigger 19 mounted on the housing 1 can touch the second switch 17.

The rotary transmission unit 2 includes a motor 21, a flywheel 22, a solenoid 24, and a moveable driving wheel 26.

The motor 21, which is securely mounted on bottom ends of the supporting bracket 11, 12 can be driven by the battery pack 10 controlled via the first switch 16 or the second switch 17. Alternatively, the motor 21 may be driven by other AC (Alternating Current) power supplies via a conductive wire. A drive belt wheel 210 is disposed on an axis of the motor 21.

The configuration of the flywheel 22 is similar to the configuration of the belt wheel 210. The flywheel 22 is pivotally mounted on a stop shaft 13, which is fixedly mounted between a supporting arm 14 and the supporting bracket 12 to cause the flywheel 22 to locate above the motor 21. The supporting bracket 11 outwards extends to form supporting arm 14 thereon. A belt 211 is wrapped around the drive belt wheel 210 and the flywheel 22 to cause rotation of the flywheel 22. In addition, an end side of the flywheel 22 outwards extends to form a cylinder 23, thereby rotating together with the flywheel 22. Alternatively, the cylinder 23 may be fixedly attached to the flywheel 22. The cylinder 23 should be made of magnetic materials regardless of attachment of the cylinder 23 to the flywheel 22. A ring-shaped receiving chamber 230 is defined in the cylinder 23.

Figure 6A:
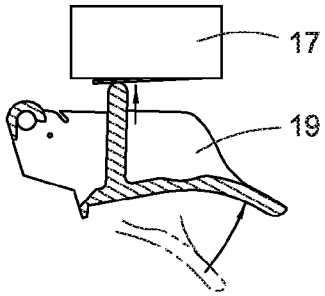
FIG. 6*a* to FIG. 6*d* is a working schematic view of the first preferred embodiment of the present invention, starting another operation mode.
Figure 6C:
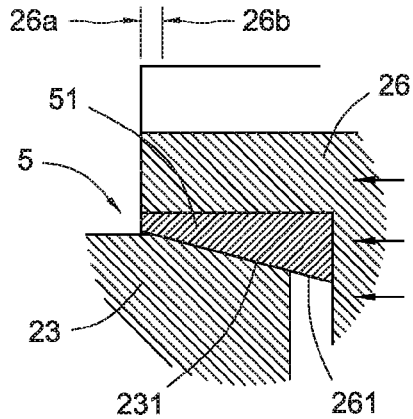
Figure 6B:
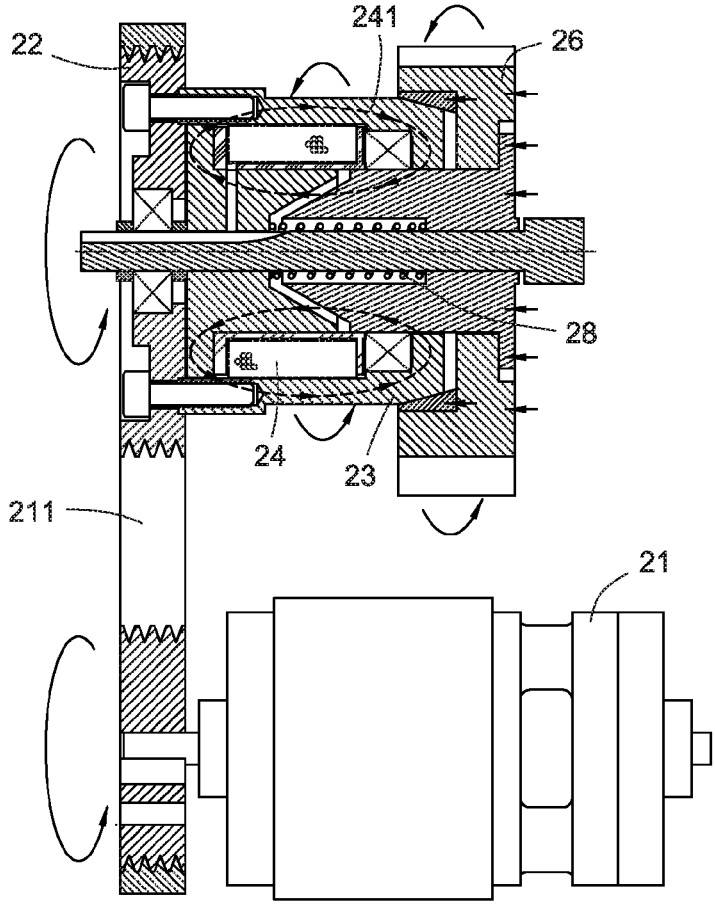

The solenoid 24, which is buried in the receiving chamber 230 of the cylinder 23, does not rotate along with the flywheel 22 and the cylinder 23. In the first embodiment of the present invention, the solenoid 24 is wrapped around an insulated ring stand 240 and may be activated by current which is controlled by the first switch 16 or the second switch 17. Thus, a magnetic conductivity loop 241, as shown in FIG. 6*b*, is constructed around the cylinder 23 when the solenoid 24 is activated, so that a magnetic field is produced. In detail, a ring-shaped bearing 25, made of a magnetic material, is securely mounted on the stop shaft 13, and the ring stand 240 is fixedly attached to an outside wall of the bearing 25 to cause the ring stand 240 to securely disposed on the stop shaft 13 via the bearing 25.

Figure 5A:
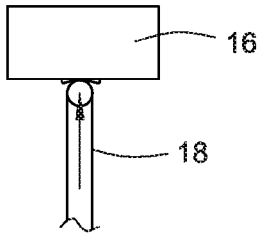
FIG. 5*a* to FIG. 5*c* is a schematic view of the first preferred embodiment of the present invention, starting an operation mode in the working status.
Figure 5C:
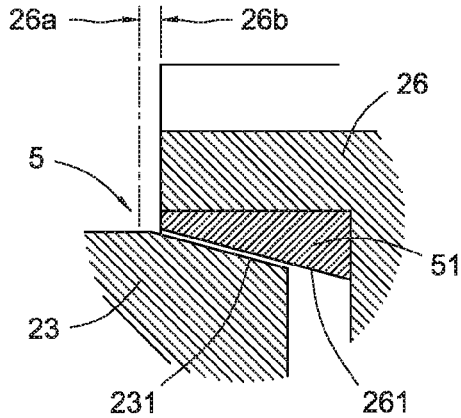

The moveable driving wheel 26, adjacent to an end side of the cylinder 23, is pivotally disposed between an engagement position 26*a* (shown in FIG. 6*c*) and a disengagement position (shown in FIG. 5*c*). In detail, the driving wheel 26 is fixedly disposed on a ring-shaped traction stand 27 which is made of a magnetic material. The traction stand 27 is moveably and pivotally mounted on the stop shaft 13. An end of the traction stand 27 is formed to have at least a protruding block 271 which is used to push the driving wheel 26 to move towards the cylinder 23. Further, two opposite slantwise end surfaces 231, 261 are respectively formed on the cylinder 23 and the driving wheel 26 to be used as a clutch 5. In detail, the clutch 5 includes a plurality of slantwise linings 51 fixedly mounted on the driving wheel 26. One of side walls of the slantwise linings 51, adjacent to the end surface 231 of the cylinder 23, may be regarded as an end surface 261. Thus, the slantwise linings 51, the cylinder 23, and the driving wheel 26 cooperatively constitute a clutch 5 which can be engaged or disengaged.

In addition, the present invention also includes an elastic member 28 configured for exerting an acting force on the driving wheel 26, thereby pushing the driving wheel 26 from the engagement position 26*a* (shown in FIG. 6*c*) to the disengagement position 26*b* (shown in FIG. 5*c*). Generally, the acting force should be less than an applied force which the magnetic field attracts the driving wheel 26 to move. In the first embodiment, as shown in FIGS. 2 and 3, the elastic member 28 may be a coil spring which is received between a tapered slot 250 defined in the bearing 25 and a receiving slot defined in the traction stand 27.

Figure 6D:
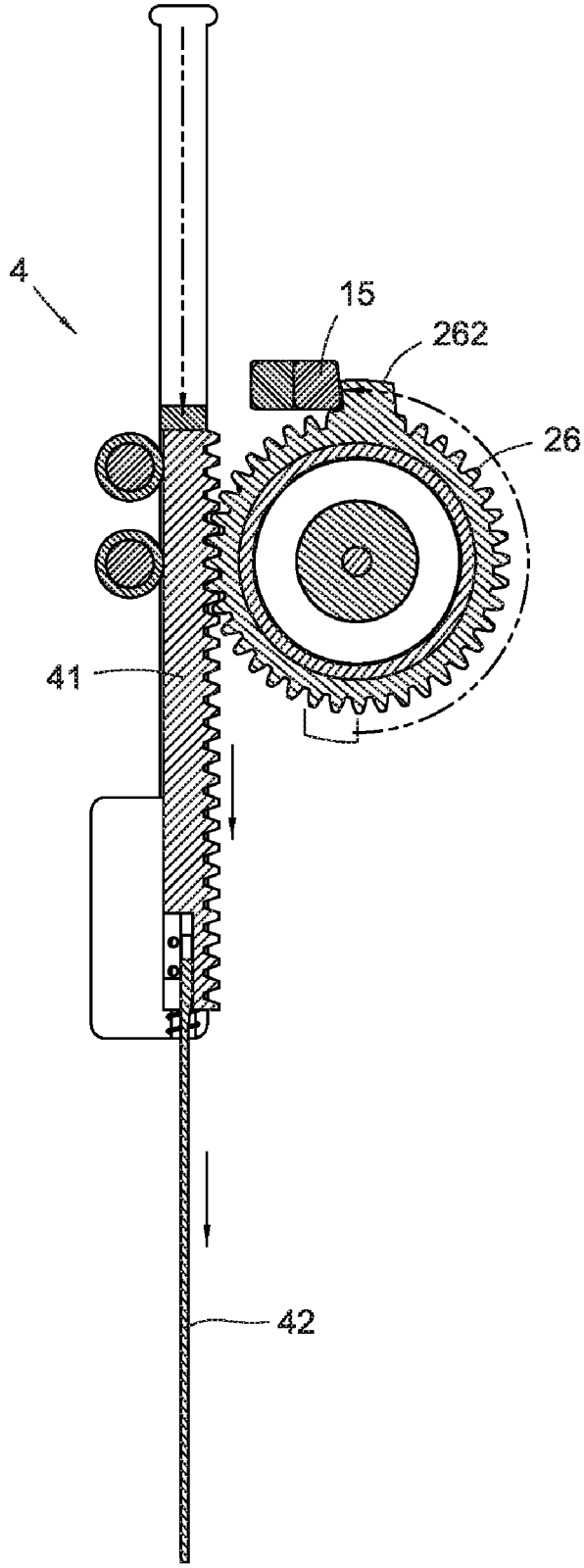

Furthermore, the driving wheel 26 may be substantially a gear wheel, and the linear transmission unit 4 substantially includes a rack 41 in mesh with the gear wheel 26. A stroke bar 42 is formed on the rack 41 so that the stroke bar 42 can impact a nail when the rotary kinetic energy of the gear wheel 26 is transformed into the linear kinetic energy of the rack 41 (shown in FIG. 6*d*). Moreover, a stop block 262 is extended from the gear wheel 26, and a brake post 15 is transversely disposed between the two supporting brackets 11, 12. When the rotary kinetic energy of the flywheel 22 is transformed to the gear wheel 26 via the cylinder 23 and the clutch 5, the brake post 15 can limit the gear wheel 26 to rotate, thereby controlling a linear displacement of the rack 41.

According to the above-mentioned configuration, two operating modes, such as a sequential actuation and a contact actuation, are performed in first embodiment of the present invention, and described in detail as follows.

Figure 4:
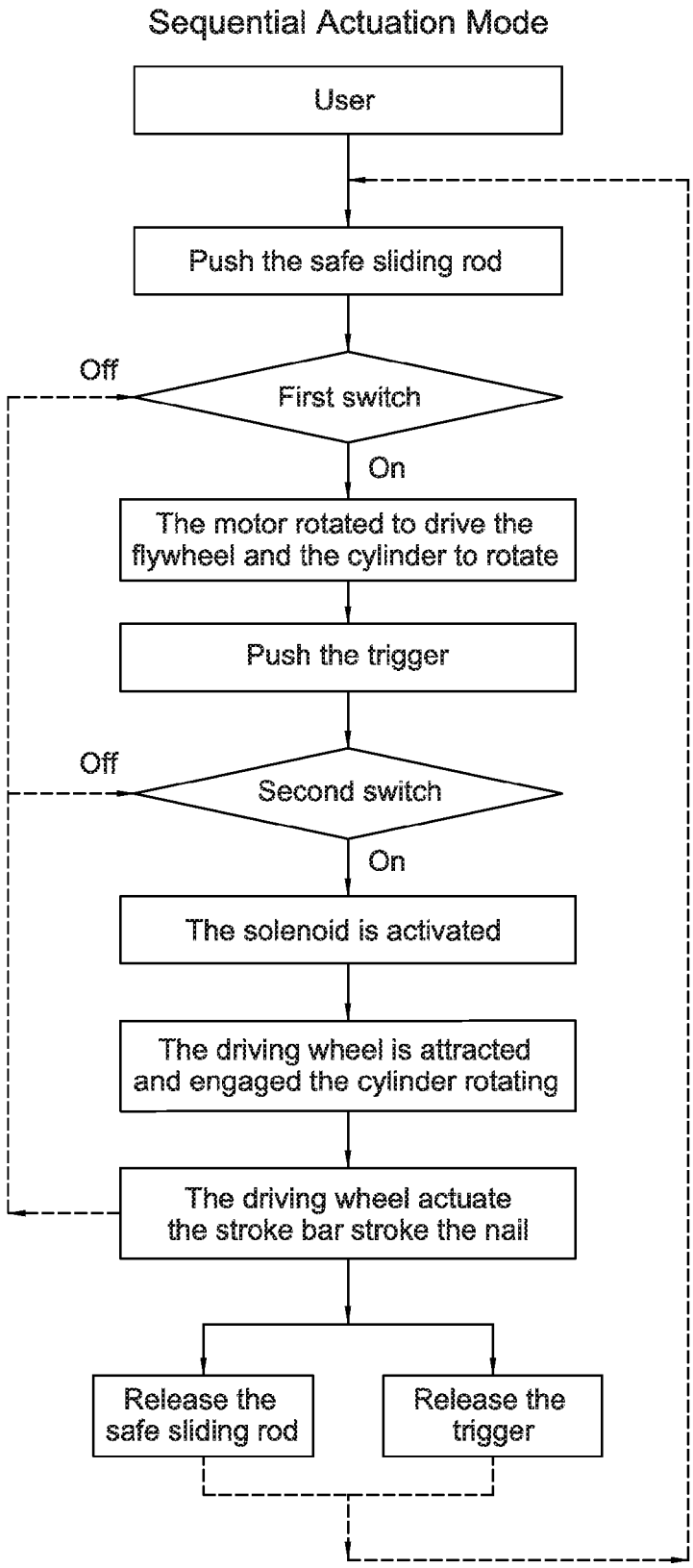
FIG. 4 is a flow diagram of the first preferred embodiment of the present invention, performing a sequential actuation mode.

FIG. 4 shows one of the two operating modes which is designated as the sequential actuation. The safe sliding rod 18 is first pushed against the workpiece by a user. The first switch 16 (shown in FIG. 5*a*) is then switched on to cause the motor 21 to rotate, thereby driving the flywheel 22 and the cylinder 23 to rotate via the belt 211 (shown in FIG. 5*b*). Subsequently, the user pushes the trigger 19 to switch on the second switch 17 (shown in FIG. 6*a*). Thus, the current from the battery pack 10 flows towards the solenoid 24 to cause the solenoid 24 to be activated. Therefore, the magnetic conductivity loop 241, as shown in FIG. 6*b*, is constructed around the cylinder 23 when the solenoid 24 is activated. The magnetic field is thus produced to attract the driving wheel 26 to push against the elastic member 28, thereby urging the driving wheel 26 to move from the disengagement position 26*b* to the engagement position 26*a*. The rotary kinetic energy of the flywheel 22 and the cylinder 23 is immediately passed on to the driving wheel 26 to urge the driving wheel 26 to rotate, thereby downwardly moving the rack 41 (shown in FIG. 6*d*). The rotary kinetic energy of the flywheel 22 and the cylinder 23 is transformed into the linear kinetic energy of the stroke bar 42 until the stop block 262 of the driving wheel 26 is stopped by the brake post 15. Meanwhile, the first and second switches 16 are automatically switched off so that the motor 21 stops rotating, the solenoid 24 is off, and the magnetic conductivity loop 241 is demagnetized to cause the magnetic field to vanish. Accordingly, the driving wheel 26 is pushed to the disengagement position 26*b* due to recovery of the elastic member 28, thereby disengaging from the flywheel 22. As such, the rack 41 stops moving downwards, and then the rack 41 returns to the original position due to recovery of an elastic member 43 in the linear transmission unit 4. A single sequential actuation is thus finished as the user releases the safe sliding rod 18 and the trigger 19. If the next operation need to be performed, the user may repeat the above-mentioned sequential actuation. Consequently, it is a safe design for avoiding a mis-operation.

Figure 5B:
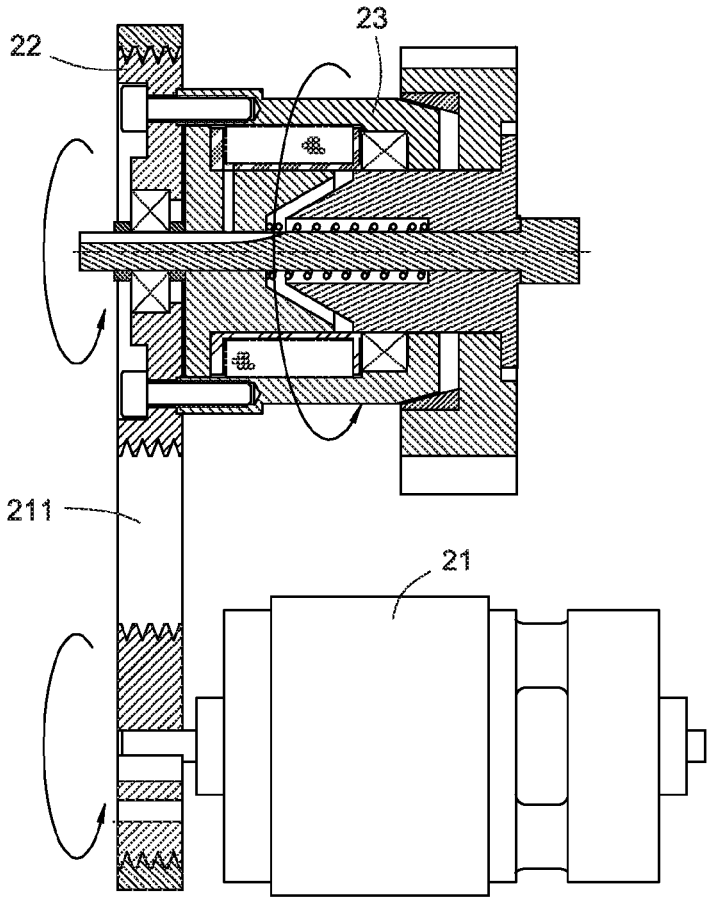
Figure 7:
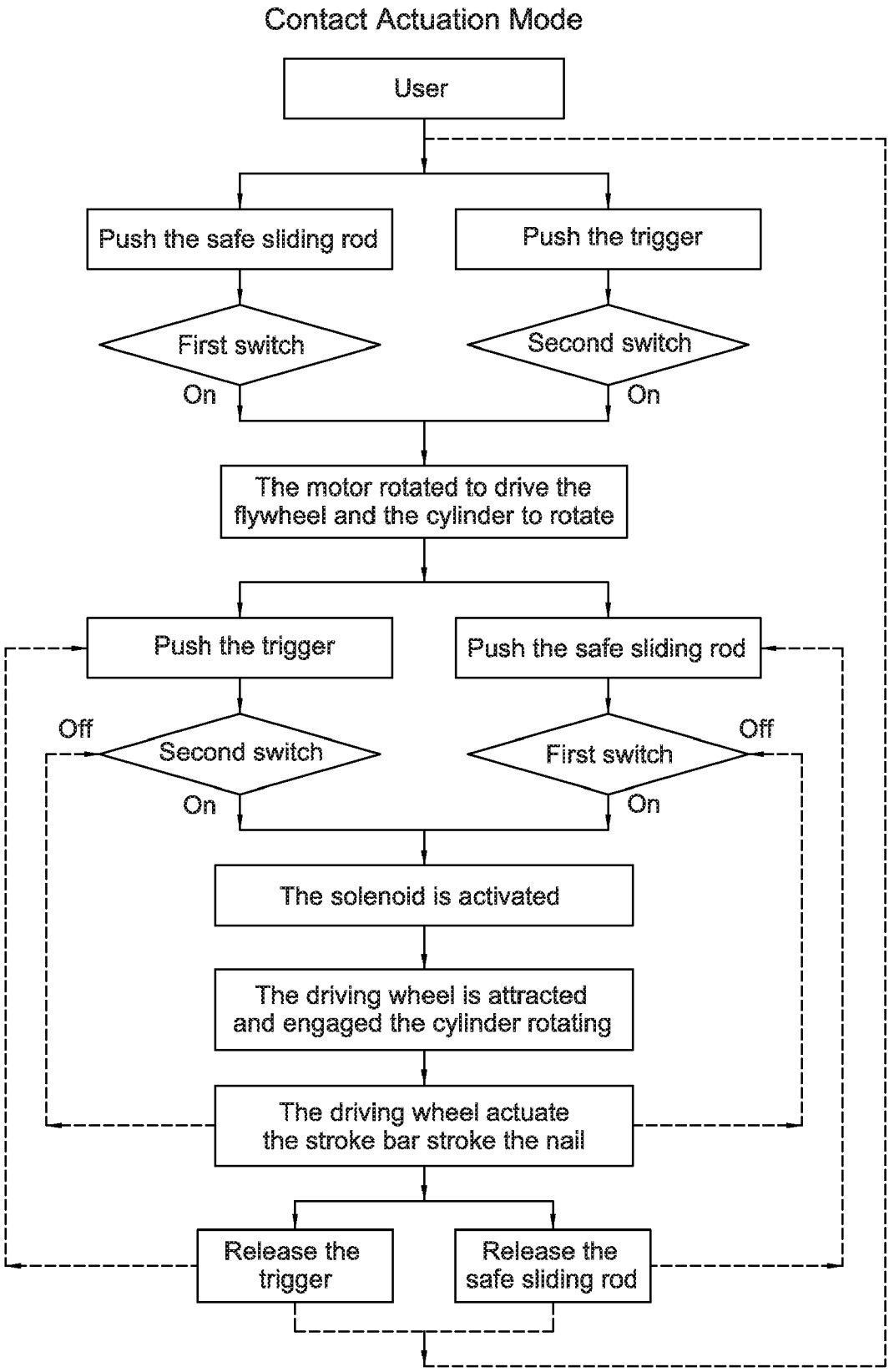
FIG. 7 is a flow diagram of the first preferred embodiment of the present invention, performing a contact actuation mode.

FIG. 7 shows the other operating mode which is designated as the contact actuation. At first, the user may selectively push the safe sliding rod 18 against the workpiece or push the trigger 19 to switch on the first switch 16 (shown in FIG. 5*a*) or the second switch 17 (shown in FIG. 6*a*), thereby causing the motor 21 to rotate. The motor 21 drives the flywheel 22 and the cylinder 23 to rotate via the belt 211 (shown in FIG. 5*b*). When the safe sliding rod 18 is first pushed against the work piece by the user to urge the flywheel 22 and the cylinder 23 to rotate. Subsequently, the user pushes the trigger 19 to switch on the second switch 17 to perform transmission of kinetic energy like the above sequential actuation operating mode. The difference lies in: after the first stroke nail operation is completed, the user may only release the safe sliding rod 18 and not release the trigger 19, or only release the trigger 19 and not release the safe sliding rod 18, if the safe sliding rod 18 is pushed again or the trigger 19 is pushed again, the second stroke nail operation is thus started. When the user first pushes the trigger 19 to switch on the second switch 17 to cause rotation of the flywheel 22 and the cylinder 23 (as shown in FIGS. 5*a* and 5*b*). Subsequently, the safe sliding rod 18 is pushed by the user to switch on the first switch 16, thereby causing the solenoid 24 to be activated. Thus, the magnetic conductivity loop 241, as shown in FIG. 6*b*, is constructed around the cylinder 23 to produce the magnetic field when the solenoid 24 is activated. The sequent transmission of kinetic energy and stroke nail operation is the same to the aforementioned operation. It is a contact actuation operation mode which is advantageous to a continuous stroke nail operation.

Figure 8:
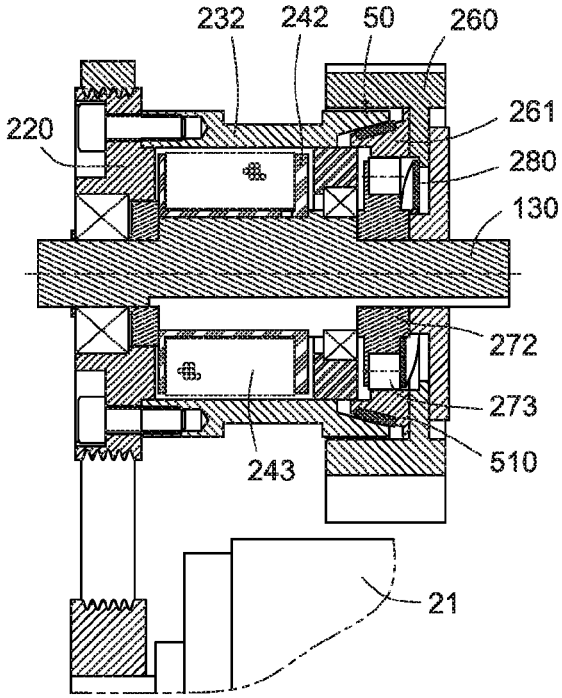
FIG. 8 is a cutaway view of a transmission mechanism for an electrical nail gun in accordance with the second preferred embodiment of the present invention.
Figure 8A:
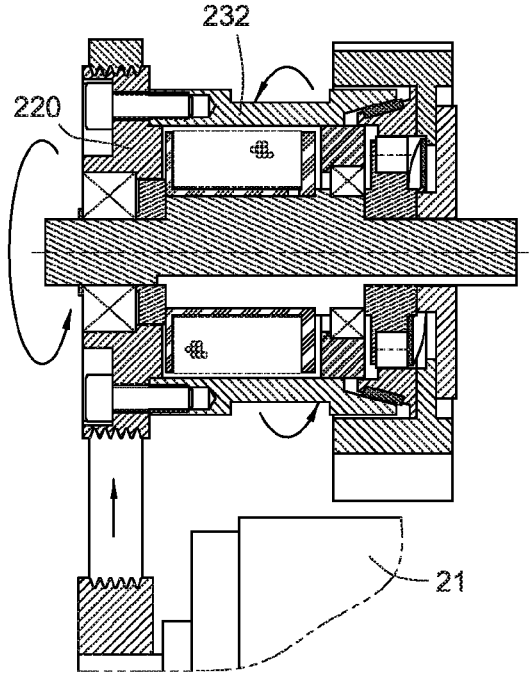
FIG. 8*a* to FIG. 8*b* is a schematic view of FIG. 8 in the working status.
Figure 8B:
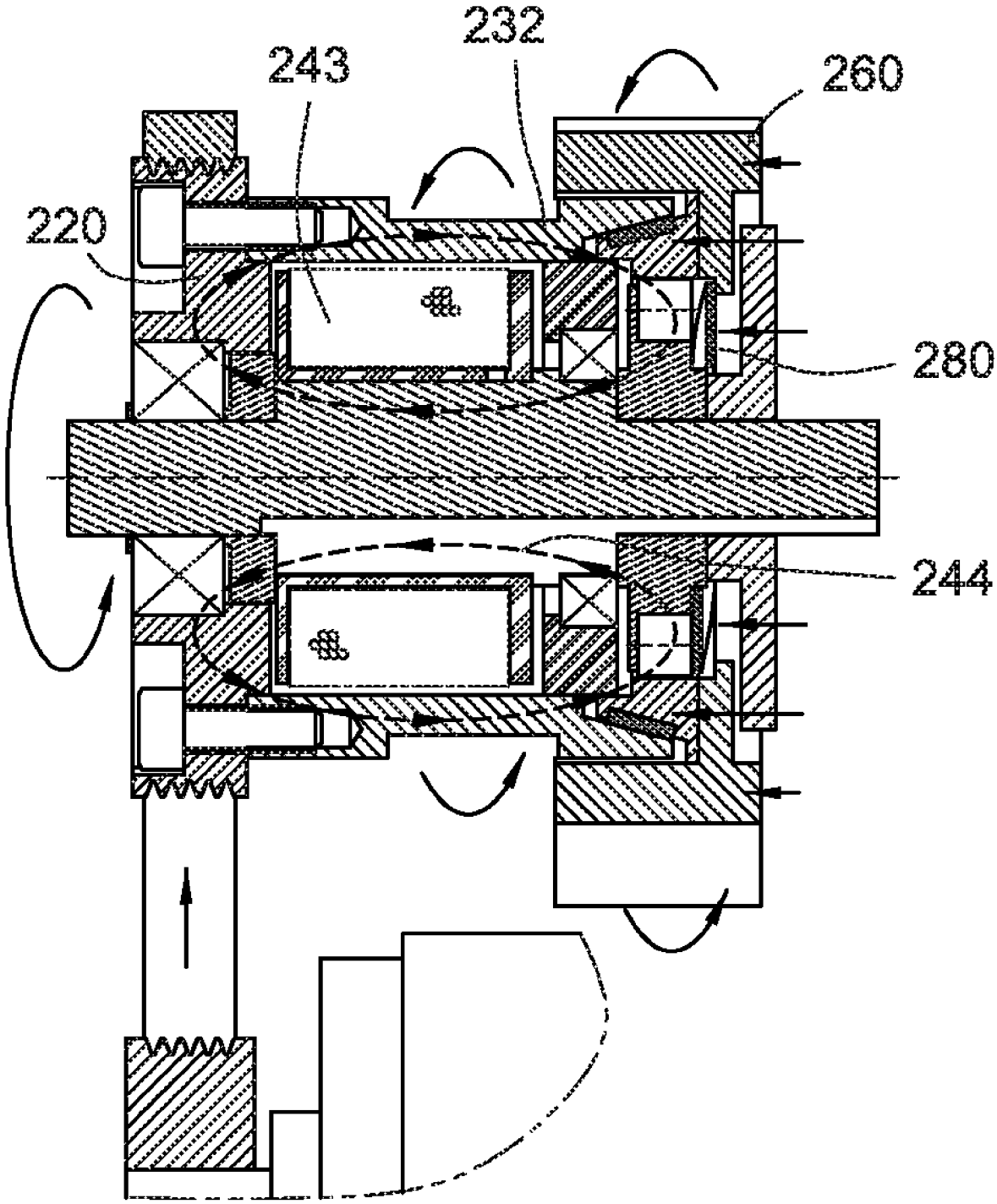

Referring to FIG. 8, a transmission mechanism for an electrical nail gun in accordance with a second embodiment of the present invention is shown. The difference between the first and second embodiments lies in: a center portion of a stop shaft 130 is broadened to make a ring stand 242 fixedly attach to the stop shaft 130, thereby replacing the bearing 25. The traction stand may be replaced by a ring-shaped disk stand 272 made of a magnetic material. A plurality of rolling posts 273 is accommodated in an edge of the disk stand 272, which is securely mounted on the stop shaft 130. A clutch received stand 261, made of a magnetic material, is fixedly mounted on the driving wheel 260. A lining 510 is securely attached to the clutch received stand 261. The driving wheel 260 is rotatably and moveably disposed on the rolling posts 273 via the clutch received stand 261. An elastic member 280 may be generally an elastic cushion disposed between the disk stand 272 and the driving wheel 260. Besides, the second embodiment is similar to the first embodiment. Hereby, the motor 21 drives the flywheel 22 and the cylinder 23 to rotate (shown in FIG. 8*a*). Further, the magnetic conductivity loop 244 is constructed around the solenoid 243 to produce the magnetic field when the solenoid 243 is activated. Simultaneously, the magnetic field attracts the driving wheel 260 to move to the engagement position, thereby causing rotation of the driving wheel 260 (shown in FIG. 8*b*). The rotary kinetic energy of the flywheel 22 and the cylinder 23 is transformed into the linear kinetic energy of the stroke bar 42, thereby performing a stroke nail operation. Meanwhile, the first and second switches 16 are automatically switched off so that the motor 21 stops rotating, the solenoid 243 is off, and the magnetic conductivity loop 244 is demagnetized to cause the magnetic field to vanish. Accordingly, the driving wheel 260 is pushed to the disengagement position (shown in FIG. 8*a*) due to recovery of the elastic member 280, thereby disengaging from the flywheel 22. A single stroke nail operation is thus finished.

To sum up, the present invention has sufficiently taught necessary technical features which can be employed in industry. It is a novelty for employing magnetic field effect of the solenoid to control engagement or disengagement of the driving wheel in/from the flywheel and for a transmission method of kinetic energy. A reasonable configuration for the flywheel, the solenoid, the clutch, and the driving wheel causes space-saving. Furthermore, it is a advantageous to improve durability of the transmission mechanism for the electrical nail gun.

While the present invention has been illustrated by the description of preferred embodiments thereof, and while the preferred embodiments have been described in considerable detail, it is not intended to restrict or in any way limit the scope of the appended claims to such details. Additional advantages and modifications within the spirit and scope of the present invention will readily appear to those skilled in the art. Therefore, the present invention is not limited to the specific details and illustrative examples shown and described.

What is claimed is:

1. A transmission mechanism for an electrical nail gun, comprising:

a rotary transmission unit in a housing of the electrical nail gun; and a linear transmission unit in the housing, comprising:

a motor driven by electricity;

a flywheel driven by the motor, the flywheel pivotally mounted on a stop shaft, a cylinder extended from a side of the flywheel thereon and made of a magnetic material, and the cylinder defining a ring-shaped receiving chamber therein;

a solenoid activated by electricity and buried in the receiving chamber, wherein a magnetic conductivity loop is constructed around the solenoid to produce the magnetic field when the solenoid is activated; and a moveable driving wheel rotatably disposed between an engagement position and a disengagement position adjacent to an end side of the cylinder, wherein two opposite slantwise end surfaces are respectively formed on the cylinder and the driving wheel to be used as a clutch;

wherein the driving wheel is attracted to move to the engagement position to be driven by the flywheel, thereby driving the linear transmission unit to impact a nail when the solenoid is activated by electricity, and the driving wheel returns to the disengagement position to disengage from the flywheel, thereby stopping driving the linear transmission unit when the solenoid is demagnetized.

2. The transmission mechanism as described in claim 1, wherein a ring-shaped bearing, made of a magnetic material, is securely mounted on the stop shaft, and the solenoid is wrapped around an insulated ring stand, the ring stand is securely disposed on the stop shaft via the bearing.

3. The transmission mechanism as described in claim 1, wherein the solenoid is wrapped around the insulated ring stand, and securely disposed on the stop shaft.

4. The transmission mechanism as described in claim 1, further comprising a ring-shaped traction stand is moveably and pivotally mounted on the stop shaft, and the driving wheel is disposed on the traction stand.

5. The transmission mechanism as described in claim 4, wherein an end of the traction stand is formed to have at least a protruding block which is used to push the driving wheel to move towards the cylinder.

6. The transmission mechanism as described in claim 1, further comprising a ring-shaped disk stand, made of a magnetic material, is securely mounted on the stop shaft, a plurality of rolling posts is accommodated around the disk stand, and the driving wheel is moveably and pivotally disposed on the rolling posts.

7. The transmission mechanism as described in claim 1, further comprising an elastic member configured for exerting an acting force on the driving wheel, thereby pushing the driving wheel from the engagement position to the disengagement position, and the acting force should be less than an applied force which the magnetic field attracts the driving wheel to move.

8. The transmission mechanism as described in claim 7, wherein the elastic member is disposed between the ring-shaped bearing securely mounted on the stop shaft and the traction stand moveably and pivotally attached to the stop shaft.

9. The transmission mechanism as described in claim 7, wherein the elastic member is disposed between the ring-shaped disk stand securely mounted on the stop shaft and the driving wheel.

10. The transmission mechanism as described in claim 1, wherein the driving wheel is substantially a gear wheel, and the linear transmission unit at least comprises a rack in mesh with the gear wheel.

* * * * *